United States Patent [19]

Fisher, Jr., deceased

[11] 4,444,252

[45] Apr. 24, 1984

[54] SLACK ADJUSTMENT FOR SLIP SYSTEM IN DOWNHOLE WELL APPARATUS

[75] Inventor: Hiram H. Fisher, Jr., deceased, late of Houston, Tex., by Hiram H. Fisher, III, executor

[73] Assignee: Baker International Corporation, Orange, Calif.

[21] Appl. No.: 391,859

[22] Filed: Jun. 24, 1982

Related U.S. Application Data

[63] Continuation of Ser. No. 272,410, Jun. 10, 1981, abandoned.

[51] Int. Cl.[3] ..... E21B 33/129; E21B 33/128

[52] U.S. Cl. ..... 166/134; 166/137; 166/217

[58] Field of Search ..... 166/134, 136, 137, 138, 166/139, 140, 215, 216, 217

[56] References Cited

U.S. PATENT DOCUMENTS

| | | | |
|---|---|---|---|
| 2,600,468 | 6/1952 | Breaux | 166/140 |
| 2,633,917 | 7/1953 | Baker et al. | 166/140 |
| 3,062,292 | 11/1962 | Lowney et al. | 166/134 |
| 3,244,233 | 4/1966 | Villalon, Jr. | 166/134 |
| 3,398,795 | 8/1968 | Elliston | 166/134 |
| 3,570,596 | 3/1971 | Young | 166/134 |
| 3,631,925 | 1/1972 | Nutten | 166/134 |
| 4,044,826 | 8/1977 | Crowe | 166/120 |
| 4,156,460 | 5/1979 | Crowe | 166/120 |

*Primary Examiner*—James A. Leppink
*Assistant Examiner*—Hoang C. Dang
*Attorney, Agent, or Firm*—Norvell & Associates

[57] ABSTRACT

A well packer having a radially extendable and retractable resilient annular sealing element and slip assembly includes a slack adjusting mechanism for maintaining the cooperating slip cones and slip members in an axially adjusted position to reduce radial play in the slip members when the slip assembly is in the retracted condition. The slack adjusting mechanism includes an internal threaded sleeve threadedly engaged with an integral tubular portion of the upper slip cone. The sleeve is disposed between the slip assembly and the sealing element and includes an annular seal urging shoulder formed thereon.

13 Claims, 6 Drawing Figures

SLACK ADJUSTMENT FOR SLIP SYSTEM IN DOWNHOLE WELL APPARATUS

This is a continuation of application Ser. No. 272,410, filed June 10, 1981, abandoned.

BACKGROUND OF THE INVENTION

1. Field of the Invention

The present invention pertains to downhole tools typically used in the oil and related industries for providing an annular seal and/or anchoring system between one conduit disposed in another and, in particular, the present invention is directed to an arrangement for adjusting the slack in the anchoring mechanism for such tools.

2. Background Art

There a number of different downhole tools used in the well drilling industry which provide for a seal to be established in the annulus between one conduit and another in the well such as between the well bore and tubing, or between the well casing and tubing disposed within the casing. A typical example of the class of tools described herein is known in the trade as a packer and is characterized by an elongated cylindrical inner housing or mandrel around which are disposed one or more resilient collars which may be axially compressed to expand radially outward into sealing engagement with the inner wall of a conduit to form an annular seal. Typically, downhole tools such as packers also include anchoring mechanisms known as slips comprising radially extendable toothed gripper elements which are engageable with the conduit inner wall for anchoring the tool in the desired position so that the seal elements are not required to withstand substantial axial loading. The seal elements and slip mechanism are usually arranged axially in an assembly which includes a setting mechanism disposed on and around the aforementioned mandrel.

Some downhole tools such as retrievable packers are fairly complex mechanical devices and require a number of components making up the setting mechanism, the slip assembly and the packing element assembly. The manufacturing tolerances required for maintaining resonable production costs, as well as the inherent design characteristics of, for example, the slip assembly results in considerable slack or axial looseness of the components when the tool is assembled in the relaxed or "running" condition. In particular, the accepted and preferred design for the slip assembly results in considerable axial looseness of the coacting parts when the slip assembly is in the relaxed or retracted position. A preferred arrangement of the slip assembly comprises radially movable slip elements having gripper teeth on the exterior surface thereof, which elements are cooperable with so called cone or wedge members. The slip cones or wedge members are adapted to be moved axially on the exterior of the mandrel to force the slip elements radially outwardly into gripping engagement with the conduit inner wall surface. The slip elements and the wedge members are normally provided with cooperating tenon and groove portions of a T-slot or dovetail configuration to retain the members in assembly with each other and to provide for the relative movement necessary during the setting and retracting operations.

The relatively loose fit between coacting parts inherent in the design of elements as described above and necessary for proper mechanical operation results in the possibility of the slip elements being so loose during the running operation of the tool that they may accidentally come into contact with the interior wall of the well conduit, which contact may result in damage to the slip elements as well as other tool components. Hence, it is desirable that in the relaxed condition of the sealing elements and the slip mechanism that there be no slack in the assembly which will permit outward radial movement of the slip elements which could result in damage to these elements or unwanted snagging to the tool during the running and retrieving operations. The present invention solves the problem of providing a slack adjustment mechanism for downhole well tools employing radially movable anchoring slips or the like, which mechanism is simple, reliable and is disposed on the tool in a highly preferred location.

Moreover, the types of tools in which the present invention is embodied tend to be mechanically complex, expensive to manufacture and available in many different models for different specific purposes thereby requiring manufacturers and users to maintain a large number of different parts for the substantial number of different tool models. However, the present invention provides a mechanically simple slack adjusting feature which is located in a highly preferred position on the tool and in which position the associated tool parts are usually not required to be of a different configuration, for different tool models.

SUMMARY OF THE INVENTION

In accordance with the present invention there is provided an improved downhole tool of the type for sealing the annular space between well conduits, which tool is provided with an improved slack adjusting mechanism to remove the slack or loose fit between components of the anchoring assembly. In particular, the present invention provides an improved slack adjusting mechanism for the radially extendable and retractable conduit gripping slips in a downhole tool such as a well packer or the like.

In accordance with the present invention there is provided a well packer having single or double sets of radially extendable and retractable anchoring slips wherein a threaded annular sleeve is provided which is threadedly engaged with one of the axially slidable slip wedge members disposed on the exterior of the packer inner housing or mandrel. Accordingly, by simple rotation of the sleeve, one end of the slip assembly is moved axially to remove any slack or looseness between the interfitting parts of the slip assembly and to thereby prevent the slips from unwanted engagement with the inner wall of the conduit through which the packer is being run to and from the working position.

Further in accordance with the present invention there is provided a slack adjusting mechanism for a retrievable well packer or the like wherein one of the wedge members of a radially extendable and retractable slip assembly is threadedly engaged with a member which also forms a shoulder engageable with a radially deformable seal or packing element of the packer. The provision of the slack adjusting mechanism between the upper wedge member of the slip assembly and the packing elements places the adjusting mechanism in an area on the tool which is normally not provided with complicated structure whose design and function might be compromised if it was required to be modified to provide for the slack adjusting function.

In accordance with another aspect of the present invention there is provided a slack adjusting mechanism for a downhole tool such as a well packer or the like wherein an axially extending sleeve portion of one of the wedge members of the slip assembly is provided with threads cooperable with mating threads on a sleeve portion which is relatively short and compact and may be easily rotated to remove the slack from the slip assembly after the tool has been assembled. The cooperating sleeve and axially extended portion of the slip assembly are also provided with a locking mechanism to prevent unwanted relative movement after the slack removing adjustment has been made.

Still further in accordance with the present invention there is provided a slack adjusting mechanism for a well packer which is rugged and capable of withstanding the substantial axial loading associated with setting the packer.

The advantages and superior features of the simple and reliable slack adjusting mechanism of the present invention and, in particular, the preferred location thereof will be further appreciated by those skilled in the art upon reading the detailed description which follows in conjunction with the drawings.

DESCRIPTION OF THE PREFERRED EMBODIMENT

Figure 1A:
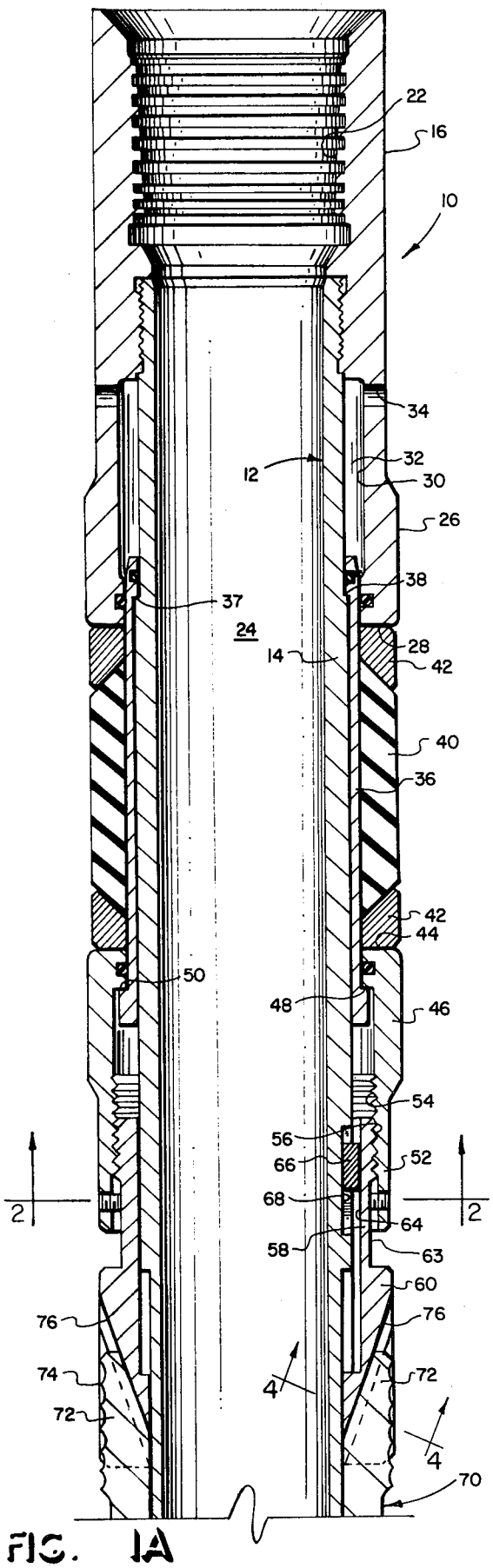
FIGS. 1A through 1C together comprise a vertical elevation view, in section, of a downhole well apparatus including the slack adjusting mechanism of the present invention.

In the drawings, the figures with combined number and letter designations are intended to be viewed together arranged vertically end to end with the first letter designation, in alphabetical order, arranged as the top section of the view and the last letter designation arranged as the bottom section. In the following description the terms upper and lower are used for convenience in regards to the normal arrangement of the apparatus when it is being inserted in a generally vertically disposed well or the like. However, for some applications the apparatus may be inverted, if desired, or used in a generally horizontal or angular direction.

Figure 1B:
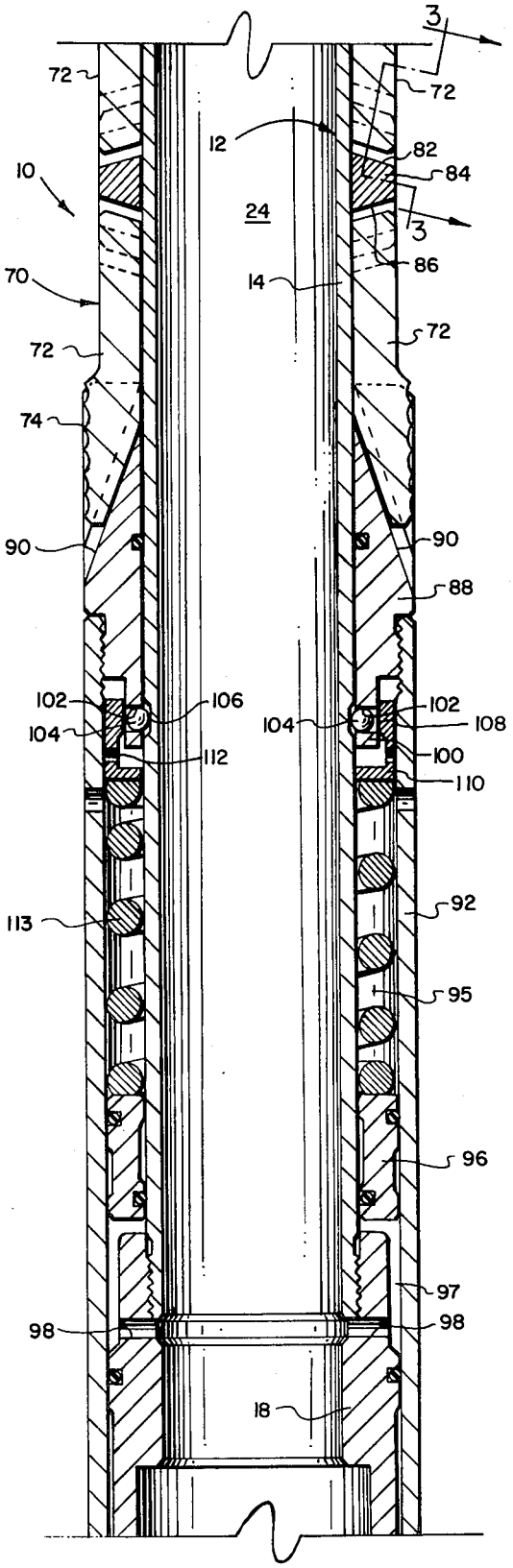
Figure 1C:
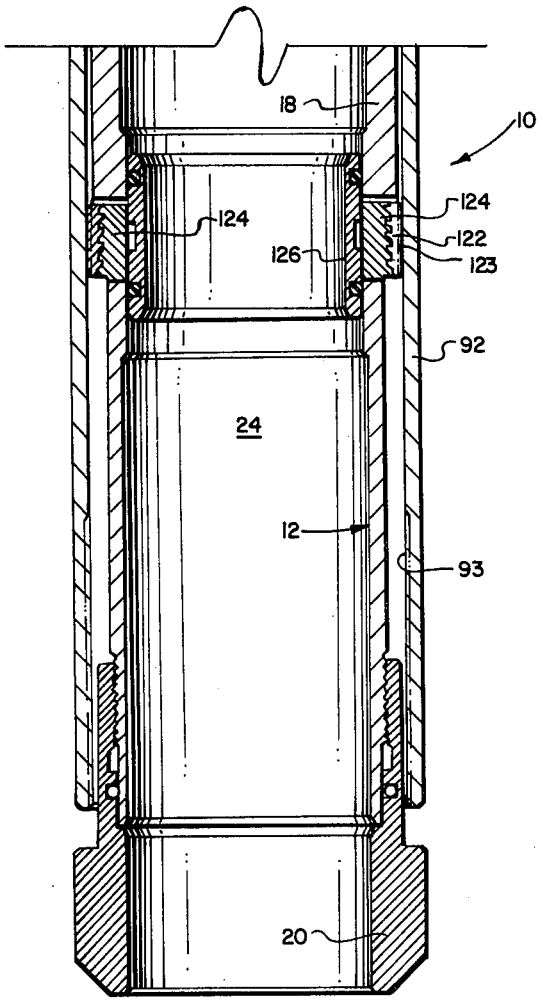

Referring to FIGS. 1A through 1C of the drawings the apparatus embodying the present invention is illustrated and generally designated by the numeral 10. The apparatus 10 comprises a downhole tool, commonly known as a well packer, for forming an annular seal between concentric conduits in a well, which seal may be provided for various purposes in developing the well. Although the slack adjusting mechanism of the present invention is particularly advantageously used with the packer 10 it will be understood by those skilled in the art that the slack adjusting mechanism may also be used with other packers as well as similar types of downhole equipment which would benefit therefrom.

The packer 10 includes an elongated cylindrical tubular inner member 12, commonly referred to as the mandrel. The mandrel 12 is made up of an elongated generally tubular section 14 which is threadedly connected at its upper end to a sub 16 and is connected at it its lower end, referring to FIG. 1B, to a second section 18. The lower end of the section 18 of the mandrel 12 is threadedly connected to a lower sub 20. The sub 16 is provided with an internally threaded portion 22 whereby the packer 10 may be connected to the lower end of a tubing string or other well tool for lowering the packer to the working position in a well bore or casing, not shown. The packer 10 is provided with an interior passage 24 formed by the bores of the members 14 and 18, through which passage various tools may be passed while performing operations in the well and through which fluids may be introduced or extracted depending on the operation being performed.

The packer 10 also includes a relatively large number of components which are held in assembled relationship around the outer cylindrical surfaces of the mandrel sectons 14 and 18. These components perform various functions including anchoring the packer 10 in a set position in a well bore and forming a fluid tight seal in the annular passageway between the inner wall of the well bore or casing and the exterior of the packer. Referring to FIG. 1A, the sub 16 comprises in effect a part of the mandrel 12 and includes an axially extending tubular portion 26 which forms an annular downward facing shoulder 28. The tubular portion 26 has an enlarged interior bore 30 providing a chamber 32 into which well fluids may be introduced through a radial passage 34. The packer 10 is provided with an elongated, so-called booster sleeve 36 which is slidably disposed around the exterior of the mandrel section 14 and is engageable with the section 14 along respective cooperating annular faces 37 and 38, as illustrated in FIG. 1A.

The packer 10 is provided with suitable fluid sealing means comprising, in the exemplary arrangement shown, a radially deformable ringlike member 40 made of a suitable elastomeric resilient material. The member 40 is positioned between substantially rigid force transmitting back up rings 42 of conventional design. The sealing means represented by the member 40 and the back up rings 42 is disposed between the downwardly facing shoulder 28 and an upwardly facing annular shoulder 44 formed on a tubular sleevelike member 46. The member 46 forms one component of a slack adjusting mechanism to be explained in further detail herein.

As illustrated in FIG. 1A, the member 46 is provided with an inner annular shoulder 48 engageable with a cooperating shoulder 50 formed on the booster sleeve 36. When the packer 10 is in the working condition the booster sleeve 36 is responsive to any fluid pressure differentials on opposite sides of the annular seal formed by the member 40 to urge the seal member further in the sealing position. The shoulder 48 could also be adapted to engage a cooperating shoulder on the section 14 if the booster sleeve 36 was not provided as shown. As will be appreciated viewing FIG. 1A the sealing element assembly is disposed in surrounding relationship to the outer diameter of the sleeve 36 and is relatively loosely supported thereon when the packer 10 is in the relaxed or so-called running condition.

Referring further to FIG. 1A, the member 46 includes an axially extending portion 52 provided with internal threads 54 which are cooperable with external threads 56 formed on an upward axially extending portion 58 of a wedge member 60. The member 60, also known as a slip cone, is part of an anchoring mechanism for the packer 10 which will be explained in further detail herein.

Figure 2:
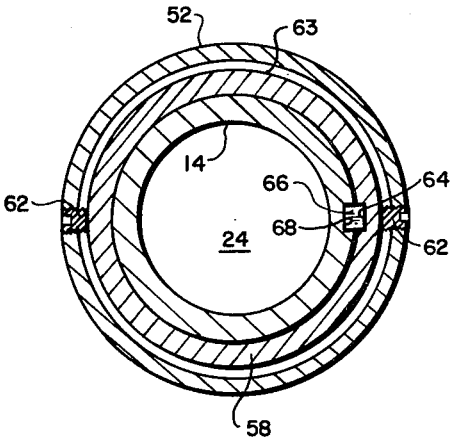
FIG. 2 is a transverse section view taken along the line 2—2 of FIG. 1A.

Referring also to FIG. 2, the lower end of the axial portion 52 includes opposed radially inwardly projecting lock screws 62 which are threadedly engaged with the member 46 and are adapted to extend into engagement with a thread relieved or undercut cylindrical surface portion 63. The screws 62 are preferably of the socket head type and are provided for locking the member 46 with respect to the member 60 to prevent relative rotation therebetween. The inner bore of the member 60 is provided with an axially extending keyway 64, in which is fitted a substantially square cross-section key 66 also extending into a keyway 68 formed in the outer surface of the mandrel section 14. Accordingly, the member 60 is adapted to be axially movable with respect to the section 14 but is prevented from rotating with respect to said section by the key 66.

Figure 3:
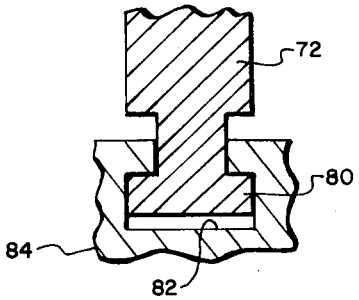
FIG. 3 is a detail section view taken along the line 3—3 of FIG. 1B.
Figure 4:
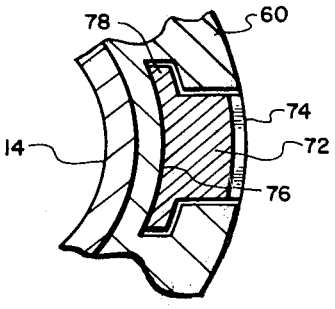
FIG. 4 is detail section view taken along the line 4—4 of FIG. 1A.

The aforementioned anchoring assembly for the packer 10 is generally designated by the numeral 70 and comprises, in the embodiment shown, a conventional double slip assembly of a known type. Referring to FIGS. 1A, 1B and FIG. 4, the slip assembly 70 includes a plurality of opposed radially movable slip members 72 which are provided with spaced apart transversely extending teeth 74 along an exterior portion thereof. As shown in FIG. 1A and FIG. 4, the wedge member 60 is provided with axially extending and radially inwardly sloping grooves 76 which have a somewhat T-shaped or so called dovetail cross-sectional configuration. The grooves 76 are cooperable with interfitting dovetail tenon portions 78 formed on the members 72. Referring to FIG. 3, the opposite ends of the members 72 are also provided with dovetail tenon portions 80 which are interfitted in cooperating grooves 82 formed in a generally cylindrical intermediate slip cone or wedge member 84. As shown in FIGS. 3 and 4, the interfitted dovetail tenons and slots are dimensioned to provide a loose fit between the cooperating members of the slip assembly to provide for ease of relative movement as is needed between these parts. As shown in FIG. 1B, a plurality of oppositely projecting members 72 are similarly interfitted in oppositely projecting grooves 86 on the member 84 and having a configuration similar to the grooves 82. The slip asssembly 70 is further provided with a lower annular wedge member 88 having sloping dovetail grooves 90 similar to the grooves 76. The wedge member 88 is threadedly engaged with an elongated housing sleeve 92 which extends downwardly in sleeved relationship around the mandrel 12, as shown.

Mechanism for unlocking the anchoring assembly 70 and for setting the packer 10 will now be described briefly. Referring to FIG. 1B in particular, the member 92 is supported in spaced relationship with respect to the mandrel section 14 to form an elongated annular space which is divided by an annular piston 96 into chambers 95 and 97. The chamber 97 is in communication with the bore passageway 24 by way of radial passageways 98. The lower distal end of the member 88 includes a reduced diameter portion 100 having opposed radially projecting holes 102, in which are disposed ball keys 104 which project radially inwardly into an annular groove 106 in the section 14 and are held in the position shown in FIG. 1B by a surface 108 on an annular sleeve member 110. The member 110 includes a radially outwardly relieved recess portion 112 which may be moved into a position overlying the ball keys 104 to permit the keys to move out of the groove 106 whereby the member 88 is free to slide axially with respect to the mandrel 12. The member 110 is retained in the position shown in FIG. 1B by suitable shear screws, not shown, interconnecting the member 110 with the housing 92 to prevent unwanted displacement of the member 110 into the alternate position described above. As shown in FIG. 1B, a coil spring 113 is disposed in the chamber 95 between the member 110 and the piston 96. Alternatively, in place of the spring 113, the piston 96 could be formed to include an axially extended sleeve portion connected to or directly engageable with the member 110.

Referring now particularly to FIG. 1C, the packer 10 is provided with a locking and release mechanism including a body lock ring 122, locking segments 124, and a release sleeve 126. Those skilled in the art will appreciate that the body lock ring 122 is of the type which has outer circumferential fine threads 123 which are cooperable with threads 93 on the inner surface of the member 92 to prevent axial movement of the mandrel 12 upward, viewing the drawing figures, with respect to the member 92. A detailed discussion of the locking and release mecanism including the lock ring 122, the segments 124, and the release sleeve 126 may be obtained by referring to U.S. patent application Ser. No. 190,308 assigned to the assignee of the present invention.

As will be appreciated from the foregoing description the considerable number of parts making up the anchoring assembly, the sealing or packing assembly and the associated structure would require the maintenance of very critical dimensional tolerances of all parts in order to properly position the parts in the relaxed condition without having either an interference condition on the one hand or too much slack or looseness of the related parts on the other hand. Moreover, the tenon and groove connections between the members 72 and the members 60, 84 and 88 are dimensioned such that, in order to provide for adequate relative movement between these parts to allow the slip members to easily and reliably move radially inwardly and outwardly, a considerable amount of axial play or looseness is inherently present in the relaxed or retracted position of the members 72.

However, it is important that, when the packer 10 is being run into and out of the well bore or casing, the members 72 be held at least snugly in their retracted positions with all of the slack taken out of the dovetail connections so that the teeth 74 do not engage the interior wall of the well casing or other conduit through which the packer is being run. In order to provide reasonable manufacturing tolerances on all of the interrelated parts described above and yet permit this snug fit it has been deemed desirable to provide a slack adjusting mechanism which may be easily adjusted once the tool has been assembled. Such a mechanism eliminates the need for maintaining critical dimensional relationships of the parts of the outer housing and the anchoring and sealing assemblies during the manufacture thereof, or alternatively the requirement for either selective assembly of the parts or the addition of shims or spacers.

Moreover, in accordance with the present invention it has been determined that it is highly desirable to place the slack adjusting mechanism in the preferred position between the anchoring assembly and the sealing mechanism as exemplified by the arrangement in the packer 10. The provision of two members which are adapted to be axially movable with respect to each other and include one of the slip cones or wedge members simplifies the overall construction of the packer since the construction of the setting and releasing mechanisms does not have to be compromised to include a slack adjusting mechanism.

In the manufacture of a packer incorporating the slack adjusting mechanism located in the preferred position according to the arrangement of the present invention conventional dimensional tolerances in the metal working art may be maintained in manufacturing virtually all of the components disposed between the sub 16 and the sub 20 and mounted around the mandrel 12. In particular, the dimensions of the tenons 78 and 80 and the grooves 76, 82, 86 and 90 may be controlled so that a relatively loose fit is formed between the memers 72 and cooperating members 60, 84 and 88. By maintaining relatively loose fits between the slip members 72 and the cooperating wedge members, reliability of performance of the wedging action in the radial outward movement of the members 72 is enhanced, in particular, considering the problems associated with the working environment of a downhole tool such as a well packer. By maintaining relatively loose fits between the tenon and groove portions the setting and release actuating movement of the slip members is effected without a tendency to jam the sliding connections between the slip members and the respective wedge members.

In the operation of preparing the packer 10 for insertion into a well or the like the components disposed around the mandrel 12 are assembled thereover in accordance with conventional practice and after complete assembly any slack or looseness in the slip members 72 is adjusted to virtually zero axial play by rotating the member 46 until the member 60 is moved upwardly to remove all slack in the slip assembly. The member 88 is prevented from axial movement by the ball keys 104 when the member 110 is in the position shown in FIG. 1B. When the member 46 has been rotated sufficiently to remove slack in the slip assembly 70 the lock screws 62 are inserted in the member 46 and tightened against the outer annular surface 63 to prevent further relative rotation between the members 46 and 60. Those skilled in the art will appreciate that the lock screws 62 could be replaced by interference fit type threads for the threads 54 and 56 or the threads could be provided with other locking insert type devices. However, the lock screws 62, being retractable out of engagement with the surface 63, permit easy rotation of the member 46 which is of some importance on a tool which may be anywhere from 4.5 to 14 inches in diameter and 4 to 6 feet in length.

The operation of the packer 10 to be set and released in its working position forms no part of the present invention and is believed to be readily understandable to those skilled in the art from the foregoing description in conjunction with the drawings. Briefly, however, the packer 10 is set after running the packer into a well at the end of a tubing string or the like connected to the sub 16. When the packer 10 has reached the position to be set, and with a fluid tight plug, not shown, installed within the passageway 24 below the passages 98, pressure fluid is introduced into the chamber 97 to move the piston 96 upwardly under the urging of the pressure fluid to compress the spring 113. Under the urging of the spring 113, and upon shearing of the aforementioned shear screws, the member 110 will move to a position whereby the radial clearance provided by the surface 112 will allow the ball keys 104 to be moved radially outwardly to release the member 88 for axial movement with respect to the member 14. Continued movement of the piston 96, spring 113 and wedge member 88 will result in radial outward movement of the slip members 72 into gripping relationship with the inner wall of the well conduit, such as the bore wall or casing, not shown. Once the slip members 72 have moved into gripping engagement with the well conduit the continued urging of pressure fluid in the chamber 97, acting on the axial projected face area of the section 18 in the chamber, will result in further axial movement of the mandrel 12 downward relative to the combined structure of the member 46, the slip assembly 70 and the housing member 92 to elastically deform the packing element 40 radially outwardly into sealing engagement with the conduit. As the lock ring 123 moves downwardly with respect to the member 92, FIG. 1C, the cooperating wicker threads 122 and 93 will operate to lock the mandrel in the maximum downwardly urged position with respect to the member 92.

When it is desired to release the packer from the set position the fluid pressure in the chamber 97 is reduced and a suitable tool is inserted through the passageway 24 to engage the sleeve member 126. Upon sufficient axial movement of the sleeve member 126, in one direction or the other, the segments 124 will be ejected into the bore of the mandrel section 18 to release the locking connection between the mandrel and the components disposed therearound whereby the gripping engagement of the slip assembly 70 with the well conduit will be released and the packing element 40 will retract radially inward. The components disposed along the outer circumference of the mandrel 12 will then resume the respective positions illustrated in FIGS. 1A through 1C of the drawings. The relationship of the members 46 and 60, being unchanged as a result of setting or releasing the packer 10, will maintain the slips 72 in a condition wherein there is virtually no slack or axial looseness between the coacting parts of the slip assembly 70 once the packer has assumed the released position. Accordingly, the packer 10 may be retrieved from the well conduit without damaging the slips 72 and also with minimal chance of engaging or jamming the packer in the well conduit.

Although the present invention has been described herein in terms of one specific embodiment, it will be understood that this is by illustration only. The invention is not necessarily limited to the embodiment shown since further alternate embodiments will be apparent to those skilled in the art upon reading of the foregoing disclosure. Accordingly, modifications to the present invention may be made without departing from the scope and spirit of the appended claims.

What is claimed and desired to be secured by Letters Patent is:

1. Apparatus for insertion in a conduit such as a well to provide a seal in an annulus formed between said conduit and a member disposed within said conduit, said apparatus including:

an elongated mandrel;

first seal urging means disposed around said mandrel;

second seal urging means disposed around said mandrel and facing said first seal urging means, said second seal urging means being axially movable with respect to said first seal urging means in a first direction to move said seal urging means toward each other;

annular sealing means disposed between said first and second seal urging means and responsive to axial movement of said seal urging means in said first direction to move radially outwardly into sealing engagement with said conduit;

a slip assembly, including a plurality of radially movable slip members having surfaces thereon engageable with cooperable surfaces formed on means comprising a wedge member disposed around said mandrel, said wedge member being movable in a first direction to force said slip members to a radially extended position with respect to said mandrel into gripping engagement with said conduit; and slack adjusting means comprising a slack adjusting member engageable with said wedge member and disposed between said annular sealing means and said slip assembly for adjustably positioning said wedge member to cause said slip members to be retained in a radially inwardly retracted position with respect to said mandrel to substantially prevent said slip members from engaging said conduit during insertion of said apparatus therein, said slack adjusting member including said second seal urging means.

2. The apparatus set forth in claim 1 wherein said slack adjusting member comprises an annular sleeve disposed about said mandrel between said annular sealing means and said wedge member and engageable with said wedge member by way of cooperating threads formed on said sleeve and said wedge member, respectively.

3. The apparatus set forth in claim 2 wherein said sleeve includes means operable to limit axial movement of said sleeve toward said wedge member whereby in response to rotation of said sleeve with respect to said wedge member said wedge member is caused to move axially to urge said slip members into said retracted position through said cooperating surfaces.

4. The apparatus set forth in claim 3 wherein said sleeve includes an annular shoulder engageable with means connected to said mandrel for limiting the axial movement of said sleeve toward said wedge member.

5. The apparatus set forth in claim 2 wherein said wedge member includes an axially extending tubular portion having external threads formed on the distal end thereof and cooperable with internal threads formed on said sleeve.

6. The apparatus set forth in claim 5 wherein said tubular portion of said wedge member includes a cylindrical undercut portion disposed between said external threads and the remainder of said wedge member, and said apparatus includes locking means comprising at least one lock screw threadedly engaged with said sleeve and forcibly engageable with said undercut portion to prevent relative rotation between said sleeve and said wedge member.

7. The apparatus set forth in claim 2, together with locking means interconnecting said sleeve and said wedge member to prevent rotation of said sleeve with respect to said wedge member.

8. The apparatus set forth in claim 1 wherein said second seal urging means comprises an annular axially facing shoulder formed on said slack adjusting member.

9. The apparatus set forth in claim 8 wherein said first seal urging means comprises an annular shoulder formed on said mandrel and facing said shoulder formed on said means engageable with said wedge member.

10. A well packer adapted to be disposed in an elongated tubing string for insertion in a well bore or the like for forming a fluid seal in said well bore, said packer including:

an elongated tubular mandrel having a downwardly facing first annular shoulder formed thereon;

resilient annular sealing means disposed around said mandrel below said first shoulder;

means disposed in sleeved relationship around said mandrel forming an upwardly facing second annular shoulder, said sealing means being disposed between said shoulders;

slip means disposed around said mandrel and including first and second spaced apart wedge members axially movable on said mandrel, an intermediate wedge member disposed between said first and second wedge members, and radially movable slip members interengaged with said wedge members by way of cooperating groove and tenon means formed on said wedge members and on said slip members and responsive to axial movement of said first and second wedge members toward each other to be urged radially outwardly into gripping engagement with a sidewall of said well bore;

actuating means for moving said slip members and said sealing means radially outwardly into gripping and sealing engagement, respectively, with said well bore; and slack adjusting means for substantially eliminating any slack between said slip members and said wedge members in the radially retracted position of said slip members, said slack adjusting means comprising a slack adjusting member disposed around said mandrel and including said upwardly facing second annular shoulder, said slack adjusting member including a threaded portion engageable with a cooperable threaded member disposed on said mandrel between said slip means and said sealing means.

11. The apparatus set forth in claim 10 wherein one of said members of said slack adjusting means includes surface means engageable with means connected to said mandrel for limiting the axial movement of said one member in one direction on said mandrel.

12. The apparatus set forth in claim 11 wherein said apparatus includes an elongated sleeve slidably disposed on said mandrel, said sleeve including an inner annular shoulder engageable with a cooperating shoulder on said mandrel, and said sleeve including an outer annular shoulder engageable with said surface means on said one member.

13. The apparatus set forth in claim 11 wherein said cooperable threaded member of said slack adjusting means comprises an axially extending sleeve portion of one of said wedge members.

* * * * *